US007559459B2

(12) United States Patent
Schmidt et al.

(10) Patent No.: US 7,559,459 B2
(45) Date of Patent: Jul. 14, 2009

(54) FILLING OF CASH BOXES FOR CASH DISPENSERS

(75) Inventors: Alfred Schmidt, München (DE); Karl-Heinz Strasser, Olching (DE); Dirk Schelling, Starnberg/Landstetten (DE); Thomas Rauch, Aying (DE)

(73) Assignee: Giesecke & Devrient GmbH, Munich (DE)

( * ) Notice: Subject to any disclaimer, the term of this patent is extended or adjusted under 35 U.S.C. 154(b) by 351 days.

(21) Appl. No.: 10/523,646

(22) PCT Filed: Aug. 4, 2003

(86) PCT No.: PCT/EP03/08619

§ 371 (c)(1),
(2), (4) Date: Oct. 14, 2005

(87) PCT Pub. No.: WO2004/015638

PCT Pub. Date: Feb. 19, 2004

(65) Prior Publication Data

US 2006/0163797 A1 Jul. 27, 2006

(30) Foreign Application Priority Data

Aug. 7, 2002 (DE) ..... 102 36 258

(51) Int. Cl.
*G07D 11/00* (2006.01)

(52) U.S. Cl. ..... 235/379; 235/381

(58) Field of Classification Search ..... 235/379, 235/486, 381, 383, 380; 705/43; 271/162, 271/3.01

See application file for complete search history.

(56) References Cited

U.S. PATENT DOCUMENTS

| | | | | |
|---|---|---|---|---|
| 5,593,149 | A * | 1/1997 | Kimura et al. | 271/3.01 |
| 6,014,649 | A * | 1/2000 | Kobayashi et al. | 705/43 |
| 6,976,634 | B2 * | 12/2005 | Washington et al. | 235/486 |
| 6,997,377 | B2 * | 2/2006 | Washington et al. | 235/379 |
| 2004/0178564 | A1 * | 9/2004 | Graef et al. | 271/162 |
| 2004/0195302 | A1 * | 10/2004 | Washington et al. | 232/15 |
| 2004/0205024 | A1 * | 10/2004 | Washington et al. | 705/43 |
| 2007/0228152 | A1 * | 10/2007 | Washington et al. | 235/379 |

FOREIGN PATENT DOCUMENTS

DE 1 266 175 4/1968

(Continued)

OTHER PUBLICATIONS

*Automatic Transaction Facility*, IBM Technical Disclosure Bulletin, Aug. 1985, p. 1032, vol. 28(3), XP002058709.

*Primary Examiner*—Thien M Le
(74) *Attorney, Agent, or Firm*—Rothwell, Figg, Ernst & Manbeck, P.C.

(57) ABSTRACT

A method for filling ATM cassettes for automatic teller machines in branch banks provides to fill the empty or half-empty money cassette removed from the automatic teller machine of a branch bank in a mobile charging station during the drive to the next branch bank and to exchange such a money cassette for the empty or half-empty ATM cassette of this next branch bank, etc. The mobile charging station is adapted to work fully automatically. Alternatively, the filling in the mobile charging station can be effected partially manually.

20 Claims, 2 Drawing Sheets

FOREIGN PATENT DOCUMENTS

| | | | |
|---|---|---|---|
| DE | 39 09 637 | A1 | 10/1989 |
| DE | 39 31 176 | A1 | 3/1991 |
| DE | 200 17 436 | A1 | 3/2001 |
| EP | 0 665 520 | A | 8/1995 |
| EP | 0 793 196 | A | 9/1997 |
| EP | 0 881 605 | A | 12/1998 |
| EP | 1 258 842 | A2 | 11/2002 |
| WO | WO 94/11848 | A1 | 5/1994 |
| WO | WO 00/31695 | A1 | 6/2000 |
| WO | WO 00/31696 | A1 | 6/2000 |

* cited by examiner

FILLING OF CASH BOXES FOR CASH DISPENSERS

CROSS REFERENCE TO RELATED APPLICATION

This application is a 35 U.S.C. § 371 National Phase Entry Application from PCT/EP03/08619 filed Aug. 4, 2003, and designating the U.S.

FIELD OF THE INVENTION

The invention relates to a method for filling at least partially emptied money cassettes for automatic teller machines with money as well as an apparatus suitable for filling the money cassettes.

DESCRIPTION OF THE BACKGROUND ART

Automatic teller machines for dispensing money in the form of bank notes and/or coins usually are located at locations distant to each other such as branch banks, so-called cash points or other facilities authorized for receiving and/or dispensing money. The money to be dispensed is provided in the automatic teller machines in money cassettes, so-called ATM cassettes (ATM stands for automatic teller machine), which at regular intervals or on current demand are exchanged for filled money cassettes by a secure carrier. The exchanged emptied or half-emptied money cassettes are returned to a central bank or a so-called cash center, which is authorized to receive, check and dispense money and usually is located at a site of the secure carrier, and replenished in a secure surrounding there. A manipulation during the refilling operation is nearly excluded here, since usually a supervision by controlling personnel in combination with further monitoring measures (e.g. video recording) is given. Furthermore, ATM cassettes for the most part are equipped with a locking mechanism, which can only be opened with the aid of special tools or methods and therefore prevents an access during the transport.

This method requires a high expenditure of time and logistics and accordingly is expensive. It is therefore a basic matter of concern to transport only money instead of money cassettes filled with money.

In WO 00/31696 it is therefore proposed to equip every branch bank with a special self-service apparatus permitting an autonomous emptying and replenishing of the money cassettes. For this purpose the cassette to be filled is removed from the automatic teller machine, inserted into the self-service apparatus, the required number of bank notes to be replenished is automatically determined and shown to the operator. The operator then feeds a respective number of bank notes into the self-service apparatus, the bank notes then being automatically checked and loaded into the money cassette.

Such an apparatus, however, has roughly the size of a conventional automatic teller machine. Thus it is not only space-intensive but at the same time respectively expensive. In addition the feeding of the bank notes into the self-service apparatus is not sufficiently protected against manipulations.

In WO 00/31695 instead the use of expendable cassettes is proposed. A transport of the emptied cassettes there and back then is no longer necessary. With this solution several expendable cassettes are inserted into an automatic teller machine and successively brought into position. A cassette being in an operating position is opened automatically, and the bank notes, on individual demand of a customer, are provided in respective number directly from the cassette. As soon as the cassette is empty, it is disposed of in a self-maintained fashion and the next cassette is brought into position.

The use of expendables in general is rather undesirable due to waste disposal problems. In addition, particularly disadvantageous is the fact, that the system described above cannot be integrated into existing infrastructures. In fact the existing automatic teller machines would have to be replaced by special automatic teller machines suitable for the use of expendable cassettes.

SUMMARY OF THE INVENTION

It is therefore the problem of the present invention to provide a method and an apparatus for filling money cassettes for automatic teller machines located distant to each other, which permit a simpler and more cost-effective exchange of money cassettes and which at the same time can be integrated into the existing infrastructure with only low costs.

This problem is inventively solved by a method or an apparatus having the features of the independent claims. In claims dependent on these are specified advantageous developments and embodiments of the invention.

According to the invention the money cassettes are replenished in a mobile charging station, preferably during the drive from the location of an automatic teller machine to the location of a further automatic teller machine. The automatic teller machines in this connection can be located in branch banks, at so-called cash points or at any other location.

I.e. the charging station is not located at the site of the secure carrier, but, for example, in a vehicle of the secure carrier and is carried along from branch bank to branch bank. At the beginning of the drive in the transporting vehicle basically only filled money cassettes for the first branch bank to be stopped at are carried along, and for all further branch banks only cash is carried along. The empty or half-empty cassettes exchanged at the first branch bank stopped at are filled on the way to the next branch bank and there they are exchanged for the empty or half-empty cassettes removed from there.

By this means not only the transport effort in general, but also the logistic effort required for packaging, i.e. the picking and equipping of ATM cassettes, at the secure carrier is reduced.

According to a first preferred embodiment of the invention the remaining money contained in the exchanged cassettes is transferred to a return cassette and brought back to the secure carrier. One single return cassette can be sufficient for this, when at emptying the ATM cassettes the remaining money is counted and the determined value, for example, together with the ATM cassette number and/or data regarding branch bank are recorded in a manipulation-proof fashion.

According to a preferred second embodiment of the invention the remaining money is brought back directly into the circulation of money by stacking it back into the same ATM cassette immediately after the money was counted and the determined value was recorded. By this means the insurance value of the transport vehicle can be reduced, since in total less money is transported.

Preferably, the remaining money is stacked back into the cassette in such a way, that the automatic teller machine dispenses this money first, i.e. depending on the cassette system either according to the FIFO or to the LIFO principle ("first-in-first-out" or "last-in-first-out"). By this means a regular circulation of money is guaranteed.

The filling of the cassettes is effected in a manipulation-proof surrounding either in a fully automatic or, optionally, in a partially manual fashion. A manipulation by the assistant of the secure carrier shall be excluded.

For this purpose the money cassettes and the money are introduced into a self-contained housing through locks. The money is put into the lock in bundles packed to be safe from access and then is automatically identified and checked as to intactness of the bundle, so that manipulation attempts by the operator can be detected and therefore are to a large extend excluded.

In the case of a partially manual operation the operator has only indirect access to the interior of the housing. But it is advantageous, that with a partially manual operation the emptying of the cassette, the counting of the remaining money and the temporary storage of the remaining money is effected automatically, so that here to the operator no manipulation possibilities are opened up.

According to a special embodiment of the invention the operator takes hold of the money and the money cassettes in the self-contained housing via two hoses penetrating the housing wall, the ends of the hoses being gloves and the hoses being hermetically tightly closed to the housing wall. By this means the operator neither when supplying money nor when subsequently opening the bundle and filling the cassette has the possibility to steal money unnoticed.

Of course, the opening of the bundle introduced through the lock and all other actions connected with the opening, emptying, filling and again locking the cassettes can be performed fully automatically by suitable devices. The partially manual variant, however, is inexpensive and little prone to trouble. It is, in particular, usable for filling most different types of money cassettes without requiring special circumstances.

BRIEF DESCRIPTION OF THE DRAWINGS

In the following the invention is described in more detail by way of example with reference to the accompanying figures.

In FIG. 1 is shown in a diagram the course of the procedure and how the money cassettes of branch banks distant to each other are exchanged and replenished during a drive of a transport vehicle of a secure carrier. A branch bank within the meaning of the following description in this connection means every location of bank machines.

DETAILED DESCRIPTION OF THE INVENTION

At the site of the secure carrier at first a transport vehicle is loaded with money for the branch banks, in particular with bank-note bundles consisting of a number of, for example, 100, 200 or 500 bank notes. This money is needed for refilling the automatic teller machines of branch banks B, C etc., which are stopped at in the second place and later on during the drive of the transport vehicle. Additionally, for the first station to be stopped at (branch bank A) a number of packed money cassettes X are provided, which are already filled with the required kind and number of bank notes for the branch bank A.

In the branch bank A the empty or half-empty money cassettes A located in the automatic teller machines are exchanged in a conventional fashion for the pre-packed money cassettes X.

Then the empty or half-empty money cassettes A are refilled in a mobile charging station, which is carried along with the transport vehicle of the secure carrier. The refilling is effected in the transport vehicle, preferably with closed doors, and for reasons of saving time, optionally, it can also be carried out during the drive to the next branch bank B.

In the branch bank B then the replenished money cassettes A are used, so as to exchange them for empty or half-empty money cassettes B of the automatic teller machines of the branch bank B. In this way the method is continued, until all branch banks of the tour were stopped at and the transport vehicle returns to the site of the secure carrier. The money cassettes removed from the last branch bank stopped at eventually can be replenished in a cash center (not shown), preferably located at a site of the secure carrier.

When refilling the money cassettes in the mobile charging station at first the remaining money contained in the money cassette is counted and recorded together with the cassette ID number. These data are important for the correct settlement of accounts with the branch bank, from which the money cassette originally came. Furthermore, it is recorded, how much money is filled into the cassette, so as to correctly balance accounts with the branch bank, which receives the respective cassette.

In the following two variants are explained, how the money cassettes are emptied and replenished without the danger of manipulation.

Figure 1:
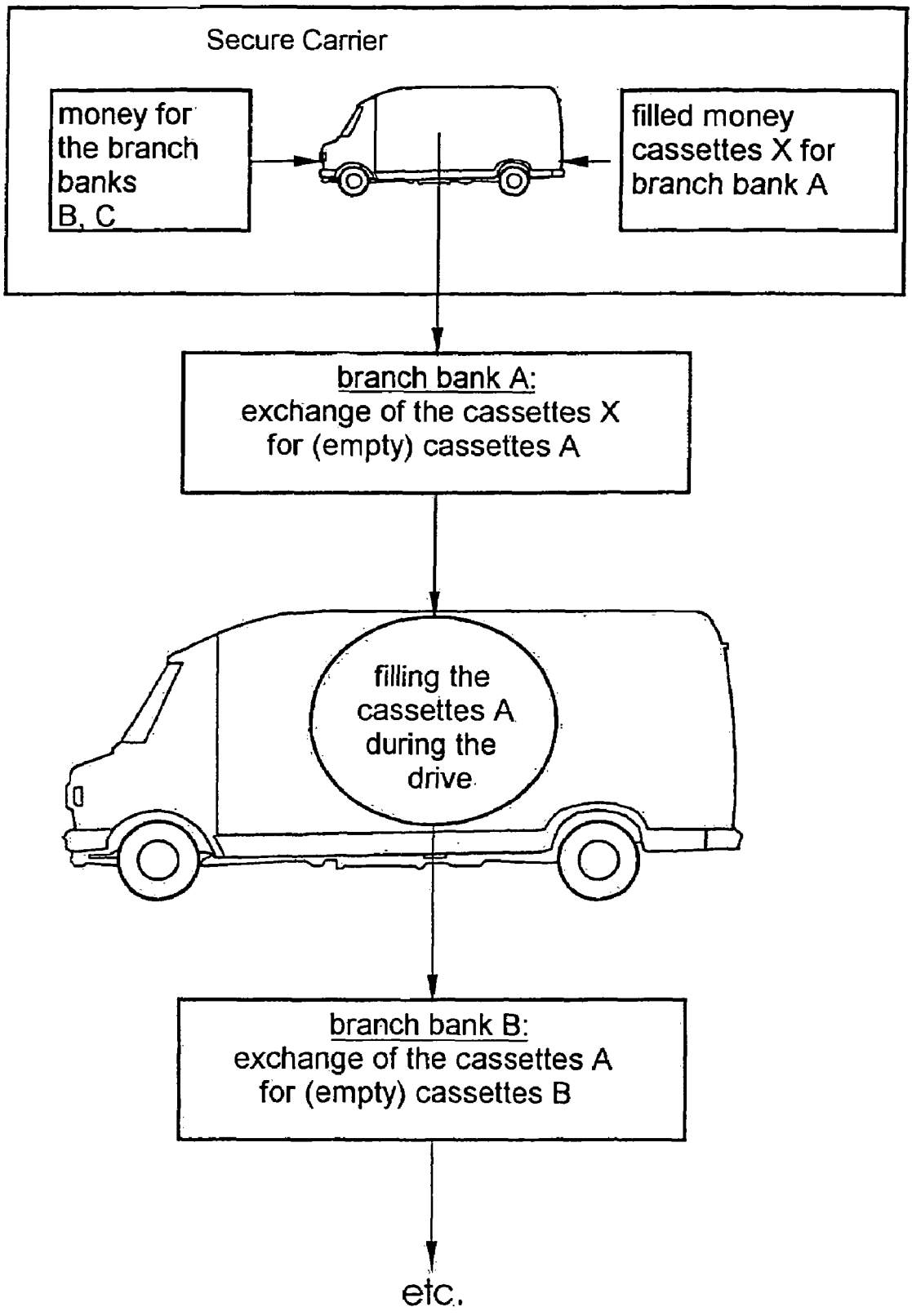
FIG. 1 shows the course of the procedure in a diagram.
Figure 2:
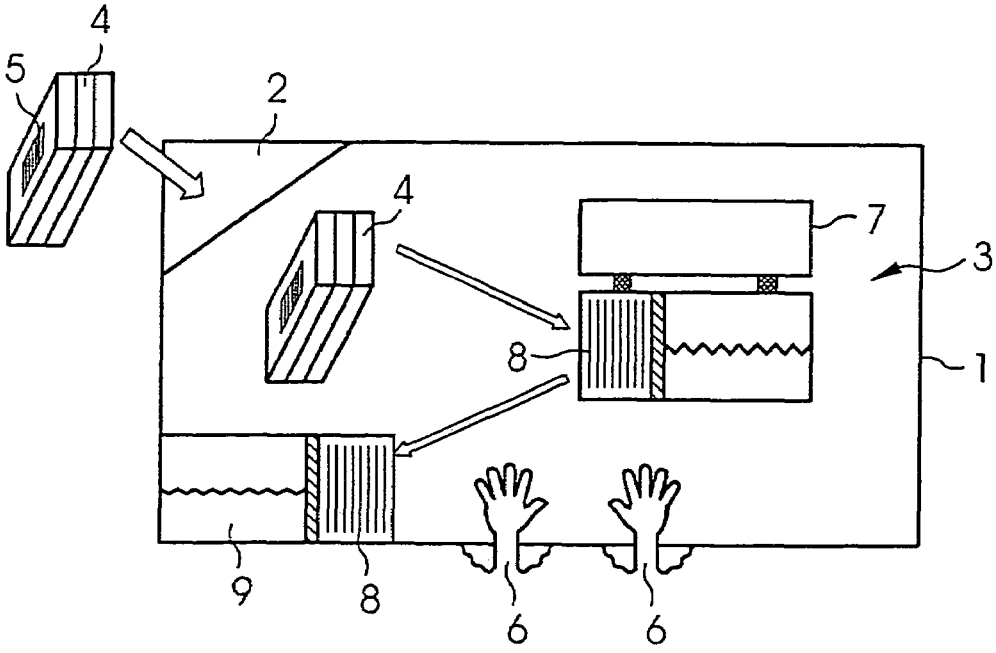
FIG. 2 schematically shows an apparatus for the at least partially manual emptying/filling of the money cassettes.

FIG. 2 in this connection schematically shows a system for filling empty or half-empty money cassettes in a partially manual fashion. This system does not have an automatic stack-in mechanism, so that the stacking in of bank notes is to be carried out via a manually controlled robot technology or directly per hand. In this embodiment this system is readily suitable for filling all commonly used types of money cassettes.

The charging station of the system shown in FIG. 2 comprises a housing 1 with a first lock 2 for supplying bank-note bundles and with a not shown second lock for introducing a money cassette 3. The housing 1 can have several different locks for introducing different types of money cassettes, so that the charging station is universally usable. The locks for the money cassettes 3 and bank-note bundles 4 are formed in such a way, that for the operator an access to the interior of the housing is impossible.

The bank-note bundles 4 at first are packed to be safe from access. They can be, for example, jig-welded under vacuum in a plastic foil in a hermetically tightly closing fashion. The intactness in this case can be detected by checking the mechanical integrity of the vacuum packaging. Such a proof can be furnished, for example, by measuring the negative pressure in the interior of the bundle 4 against the ambient pressure so as to indicate that air from outside did not pass into the interior. Another possibility is the use of special proof elements, e.g. in the form of sheets or labels, which change their color when coming into contact with oxygenous air and thus indicate the damage of the packaging.

In another embodiment special gaseous substances can be entrapped within the packaging, which will volatilize when the tightly closing packaging is damaged. The intactness in this case can be detected by checking the presence of a sufficient concentration of the special gaseous substances before opening the packaging.

The checking of the intactness of the bundle 4, of course, can also be carried out completely independent of the inventively described charging station. This is expedient, when in general e.g. a cash clerk is to check a received bank-note bundle 4 as to intactness when taking delivery thereof.

The assistant of the secure carrier introduces the money cassette 3 into the housing 1 and one or several bank-note bundles 4 into the lock 2. They carry an identification label 5, for example a bar code, which contains information on number and denomination of the bank notes included in the bank-note bundle 4. The bank-note bundle 4 in the lock 2, after the latter having been closed, is automatically checked as to intactness, and the identification label is read. The information of the identification label in combination with the cassette ID number, inter alia, serves for checking whether the denomination of the bank note bundle is correctly adjusted to the cassette type. By this means on the one hand manipulation possibilities for the assistant of the secure carrier and on the other hand the danger of false fillings are reduced from the outset. If the checking reveals, that the bank-note bundle 4 is intact, the lock 2 leading into the interior of the housing 1 is opened.

By means of work gloves 6 integrated in the housing 1 and penetrating the housing wall the assistant now can act within the housing 1. At first he will open the lid 7 of the money cassette 3 and remove the bank notes 8 left therein, i.e. the remaining money. Depending on the embodiment of the money cassette, for unlocking the lid 7 he needs (not shown) special devices or tools, which are accessible only within the housing. The remaining money 8 is transferred via a (not shown) processing unit into a return cassette 9, whereby it is singled and counted and the value is determined and recorded.

As to exclude manipulation by an assistant during this operation, according to a preferred not shown variant the steps of emptying, singling and counting the bank notes left in the money cassette 3 are automated.

The remaining money 8 can remain in the return cassette 9 and be transported back to the cash center of the secure carrier. However, preferred is a direct recycling of the remaining money 8, wherein the remaining money is transferred back into the money cassette 3 at a later point of time. If the money cassette 3, for example, works according to the FIFO principle, the remaining money 8 is stacked back into the money cassette 3 immediately after its value has been determined. By this means it is achieved, that the remaining money is dispensed first. Then the money cassette 3 is replenished with bank notes of the bank-note bundle 4.

For this purpose the assistant takes the bank-note bundles 4, checked as to intactness and correctly identified, out of the lock 2 and opens the taken out bank-note bundle by, for example, cutting open the packaging. The opening of the bank note bundle can also be effected automatically in the lock 2. An automatic opening of the bank note bundle 4 technically can be easily realized, since all bundles are independent of the cassette and therefore uniform regarding format. They can be easily produced by machine, taking into consideration the method for checking the intactness. The assistant then stacks the bank notes of the bank-note bundle 4 into the money cassette 3. Finally, the assistant locks the lid 7 of the money cassette 3 and moves out the money cassette 3 from the mobile charging station through the above-mentioned not shown lock.

If, for example, from a half-empty cassette 346 bank notes are removed and again filled in and 3 bank-note bundles 4 each counting 500 bank notes are added, then the money cassette 3 is filled with 1846 bank notes. Number and denomination of the bank notes were determined in the lock 2 as well as with the counting of the remaining money 8 and recorded together with the cassette ID number. With the help of these data there can be clearly reconstructed, how much money was removed from and supplied to the individual branch banks when exchanging the money cassettes.

Figure 3:
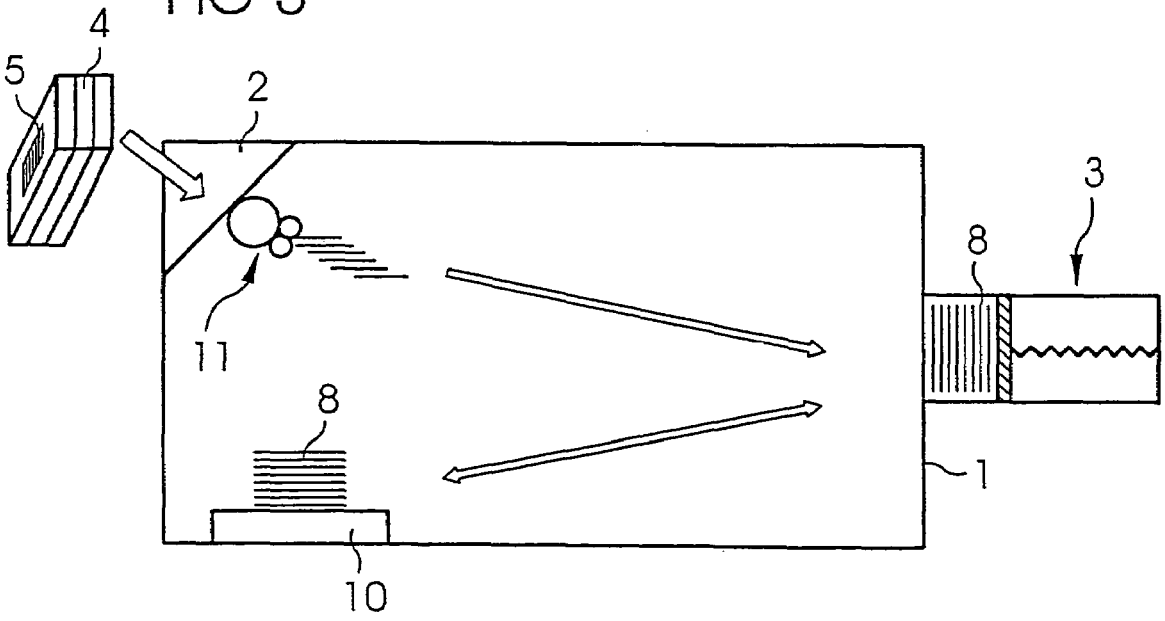
FIG. 3 schematically shows an apparatus for the automatic emptying/filling of the money cassettes.

FIG. 3 schematically shows a system alternative to FIG. 2, wherein the charging station works fully automatically. This system is suitable for special types of money cassettes 3, which are compatible with the mobile charging station.

With this fully automatic system the money cassette 3 at first is inserted into the housing 1 of the mobile charging station or, as shown in FIG. 3, is connected to the outside of the housing 1. By a not shown mechanism the money cassette 3 then is automatically emptied. Here the remaining money 8 is singled, counted and the value is determined, which is recorded with consideration of the cassette ID number. The remaining money 8 at first is temporarily stored in an intermediate cash point 10, e.g. a foil storage, as schematically shown in FIG. 3. Depending on whether the money cassette works according to the FIFO or according to the LIFO principle, the money cassette 3 at first is filled with the temporarily stored remaining money 8 and then filled up with additional bank notes, or vice versa. The required quantity of additional bank notes for filling up the money cassette 3 directly results from the number of bank notes of the remaining money 8 previously determined.

For filling the money cassette 3, bank-note bundles 4 corresponding to the determined number of required bank notes are inserted into the lock 2. The bank-note bundles 4 are identified with the help of their identification labels 5 and checked as to intactness, before they are automatically opened, singled in a singler 11, transported to the money cassette 3 via a not shown device and are stacked into this money cassette. The termination of the automatic stack-in operation is indicated to the assistant, who then removes the money cassette 3 from the charging station.

The fully automatic variant explained with respect to FIG. 3 thus to a large extent excludes the possibility of manipulation by the assistant of the secure carrier during the stack-in operation as well.

LIST of REFERENCE SIGNS

1 housing
2 lock
3 money cassette
4 bank-note bundle
5 identification label
6 gloves
7 lid
8 remaining money
9 return cassette
10 intermediate cash point
11 singer

The invention claimed is:

1. Method for filling at least partially emptied money cassettes for automatic teller machines with money, comprising the steps:

removing a first, at least partially emptied money cassette from a first automatic teller machine, and thereafter filling the first money cassette removed from the first automatic teller machine, characterized in that the filling of the first money cassette is effected in a mobile charging station, which can be transported from an automatic teller machine to at least one further automatic teller machine.

2. Method according to claim 1, characterized in that the first money cassette is exchanged for a different, in particular filled money cassette.

3. Method according to claim 1, characterized in that the first money cassette after being filled, which in particular is carried out at the place of the first automatic teller machine, again is inserted into the first automatic teller machine.

4. Method according to claim 1, characterized in that the first money cassette is transported to a second automatic teller machine, and a second at least partially emptied money cassette of the second automatic teller machine is exchanged for the first filled money cassette.

5. Method according to claim 4, characterized in that the filling of the first money cassette is effected during the transport of the first money cassette to the second automatic teller machine.

6. Method according to claim 1, characterized in that any remaining money contained in the first at least partially emptied money cassette is determined as to value.

7. Method according to claim 1, characterized in that any remaining money contained in the first at least partially emptied money cassette is transferred into a separate return cassette.

8. Method according to claim 1, characterized in that any remaining money contained in the first at least partially emptied money cassette is temporarily stored and put back into the money cassette at a later point of time.

9. Method according to claim 8, characterized in that the remaining money is reloaded into the money cassette in such a way, that it is dispensed first during the operation in an automatic teller machine.

10. Method according to claim 1, characterized in that the money for filling the money cassette is provided as a bundle, which is safe from access.

11. Method according to claim 10, characterized in that the bundle is checked as to intactness.

12. Method according to claim 11, characterized in that when checking the intactness of the bundle it is checked, whether the vacuum packaging of the bundle is mechanically undamaged.

13. Method according to claim 11, characterized in that when checking the intactness of the bundle it is checked, whether no ambient air passed into the vacuum packaging of the bundle.

14. Method according to claim 11, characterized in that when checking the intactness of the bundle it is checked, whether the packaging of the bundle contains a proof substance, which was brought in at production of the bundle, in sufficient concentration.

15. Method according to claim 10, characterized in that the bundle is introduced into a self-contained housing, into which also the money cassette is introduced or to which the money cassette is connected, and that the bundle then is automatically identified and checked as to intactness.

16. Method according to claim 11, characterized in that an operator via a suitable device indirectly takes hold of the money introduced into the housing and manually fills the money cassette with this money.

17. Mobile charging station for filling money cassettes, comprising a self-contained housing with a first lock for connecting or introducing one or more money cassettes and a second lock for supplying money, characterized in that the second lock is formed as to permit introducing one or more money bundles packed to be safe from access and has a device for identifying and checking the introduced money bundles as to intactness.

18. Mobile charging station for filling money cassettes, comprising a self-contained housing with a first lock for connecting or introducing one or more money cassettes and a second lock for introducing money for filling the money cassettes, according to claim 10, characterized by a device for indirectly manually taking hold of the money introduced into the housing and filling the money cassettes with the introduced money by an operator.

19. Mobile charging station according to claim 18, characterized in that the device for indirectly taking hold of and filling the money cassettes comprises hoses penetrating the housing wall, which on one side have a glove-shaped closed end.

20. Mobile charging station according to claim 17, characterized by a device for automatically discharging a money cassette connected to the housing or introduced into this housing.

* * * * *